US005619837A

United States Patent [19]

DiSanto

[11] Patent Number: 5,619,837

[45] Date of Patent: Apr. 15, 1997

[54] CORRUGATED PANEL STRUCTURE

[76] Inventor: Fabricio N. DiSanto, 3931 Bentley Ave., Culver City, Calif. 90232

[21] Appl. No.: 506,710

[22] Filed: Jul. 26, 1995

[51] Int. Cl.[6] ..... E04C 2/32

[52] U.S. Cl. ..... 52/798.1; 52/800.12; 52/780; 52/781; 52/630

[58] Field of Search ..... 52/798.1, 801.1, 52/801.11, 802.1, 800.1–800.12, 730.1, 731.1, 716.8, 734.1, 733.2, 730.6, 730.3, 630, 671, 674, 465, 780, 781, 255, 238.1, 241

[56] References Cited

U.S. PATENT DOCUMENTS

| | | | |
|---|---|---|---|
| 667,384 | 2/1901 | Brandt | 52/798.1 X |
| 1,609,541 | 12/1926 | Gooding | 52/783.2 |
| 1,982,104 | 11/1934 | Holdsworth | 52/241 |
| 2,078,491 | 4/1937 | Graham | 52/241 |
| 2,101,090 | 12/1937 | Palmer | 52/731.1 X |
| 2,181,831 | 11/1939 | McLaughlin | 52/731.1 X |
| 3,037,593 | 6/1962 | Webster | 52/798.1 X |
| 3,255,561 | 6/1966 | Cable | 52/255 |
| 3,568,388 | 3/1971 | Flachbarth et al. | 52/242 X |
| 3,631,647 | 1/1972 | Merkin | 52/798.1 X |
| 3,633,327 | 1/1972 | Klingensmith | 52/798.1 X |
| 3,950,912 | 4/1976 | Lundberg et al. | 52/733.2 |
| 3,976,269 | 8/1976 | Gupta | 52/801.11 X |
| 4,292,782 | 10/1981 | Schaeffer | 52/731.1 X |
| 4,426,822 | 1/1984 | Gailey | 52/781 X |
| 4,461,232 | 7/1984 | Berg | 52/801.1 X |
| 4,736,566 | 4/1988 | Krotsch | 52/798 X |
| 4,991,368 | 2/1991 | Amstutz | 52/241 |
| 5,388,358 | 2/1995 | Mazhar | 52/798.1 X |

FOREIGN PATENT DOCUMENTS

| | | | |
|---|---|---|---|
| 0531543 | 1/1922 | France | 52/730.1 |

*Primary Examiner*—Robert Canfield
*Attorney, Agent, or Firm*—Loeb & Loeb

[57] ABSTRACT

A corrugated panel structure, for use in the construction of a building wall or other structural application, includes a corrugated panel of broad, planar configuration and a pair of elongated caps mounted on opposite edges of the corrugated panel. Each of the elongated caps has a protruding central channel which is slotted to receive the individual corrugations of the corrugated panel. Each elongated cap is secured in place over an end of the corrugated panel by a rod disposed within the central channel and extending through apertures in the corrugations and end portions of the corrugated panel. Between the end portions, the corrugations form a zig-zag pattern of diagonally oriented planes which alternate in direction. Such corrugations extend in spaced-apart, parallel fashion between the opposite edges of the panel. The slots in the central channels for receiving the individual corrugations are diagonally oriented and alternate in direction relative to the directions of elongation of the elongated cap. Each cap has a pair of spaced-apart side portions on opposite sides of the protruding central channel which lie within a common plane and terminate in flanges opposite the central channel. The flanges extend at generally right angles to the common plane and are disposed over opposite portions of the adjoining edge of the corrugated panel.

6 Claims, 5 Drawing Sheets

CORRUGATED PANEL STRUCTURE

BACKGROUND OF THE INVENTION

1. Field of the Invention

The present invention relates to structural members used in the construction of buildings and the like, and more particularly to panel structures of generally broad, planar configuration which may be used in constructing the walls of a building or in similar structural applications.

2. History of the Prior Art

Panel structures, particularly those made of metal, have enjoyed increasing popularity in the construction of building walls and similar structural applications. Thus, conventional wood studs, which are nailed to a wood header at the top and to a wood baseboard at the bottom to form the basic superstructure of a wall, are increasingly being replaced by metal structural members. Hollow metal studs having a size and shape similar to wood 2×4's are installed by inserting the upper ends thereof in a generally U-shaped metal header nailed or otherwise secured to the ceiling or other structure at the top of a wall being constructed. The lower ends of the metal studs are disposed within a generally U-shaped metal footer mounted on the floor or other structure at the bottom of the wall. The metal studs are then secured to the upper and lower U-shaped members by sheet metal screws or other appropriate fasteners. Metal structural members of this type have a number of advantages over more traditional wood members, not the least of which is that they are fireproof.

While metal structural members such as the metal studs and U-shaped members described have various advantages, they nevertheless suffer from a number of shortcomings. For one thing, panel structures which are assembled from such members require a substantial amount of time to construct. In the case of the more conventional wood members, each of a plurality of wood studs must be nailed in place, both top and bottom, when constructing a building wall or other like structure. This requires considerable time. In the case of metal members, the individual metal studs must be attached to both the upper and lower U-shaped members, again requiring a substantial amount of time to complete. Once such structures are assembled, they may lack the necessary strength and rigidity for certain environments. For example, the twisting movements often undergone by a wall during an earthquake tend to tear the ends of metal studs from the upper and lower U-shaped members. For reasons such as this, such structures must often be sheared, such as by securing sheets of plywood thereto.

Accordingly, it would be desirable to provide a panel structure, suitable for use in the construction of building walls and similar structural applications, which is easily and quickly assembled. Such structures, when assembled, should have substantial strength and rigidity so as to be capable of withstanding not only the normal loads imposed by the structural applications but also occasional excess loading such as may occur during an earthquake. Such panel structures should be versatile in terms of their adaptability to a variety of different applications, such as in the construction of ceilings or roofs, as well as walls, where certain strength and rigidity characteristics are required.

BRIEF SUMMARY OF THE INVENTION

Briefly stated, panel structures in accordance with the invention are comprised of corrugated panel structures in which elongated caps are secured to the opposite edges of a corrugated panel of generally broad, planar configuration. The corrugated panel has opposite end portions and a plurality of spaced-apart, generally parallel corrugations therebetween which extend between the opposite edges of the panel. Each elongated cap has a protruding central channel, along the length of the cap, which has slots therein for receiving the corrugations of the corrugated panel. The elongated caps are secured in place at the opposite edges of the corrugated panel, such as by rods disposed within the central channels and extending through apertures in the corrugations as well as the opposite end portions of the corrugated panel.

In a preferred embodiment of a corrugated panel structure in accordance with the invention, the plural corrugations of the panel form a generally zig-zag pattern between opposite end portions of the panel so as to be diagonally oriented and to alternate in direction relative to a direction of elongation of the corrugated panel and the elongated caps. Slots within the protruding central channel of each elongated cap receive the corrugations therein. Elongated rods disposed within the protruding central channels of the elongated caps extend through apertures in the corrugations and in the opposite end portions to secure the elongated caps in place on the opposite edges of the corrugated panel. The protruding central channel of each elongated cap is of generally V-shaped cross-sectional configuration and is disposed between opposite side portions lying within a common plane. Each side portion includes a flange at an outer end thereof opposite the protruding central channel which extends generally perpendicular to the common plane, so as to extend over opposite portions of the adjacent edge of the corrugated panel.

Assembly of the corrugated panel structure requires only that the opposite elongated caps be placed over the opposite edges of the corrugated panel so that the corrugations are received within the slots in the protruding central channels thereof. With the elongated caps so positioned, the caps are secured by insertion of elongated rods through the apertures in the opposite end portions and the various corrugations, so that the rods reside within the protruding central channels. In addition to finishing the opposite edges of the corrugated panel, the elongated caps structurally integrate with the corrugated panel so as to greatly strengthen and rigidify the resulting structure. The channeled caps resist lateral flexing, and thereby impart rigidity to the panel structure in this direction as well as others, by virtue of the panel edge being sandwiched therein and with the corrugations being received in the slots. Consequently, such structure is particularly resistive to twisting and other lateral loading.

BRIEF DESCRIPTION OF THE DRAWINGS

Further objects, features and advantages of the invention will be apparent from the detailed description of a preferred embodiment, below, when read in conjunction with the accompanying drawings, in which.

DETAILED DESCRIPTION

Figure 1:
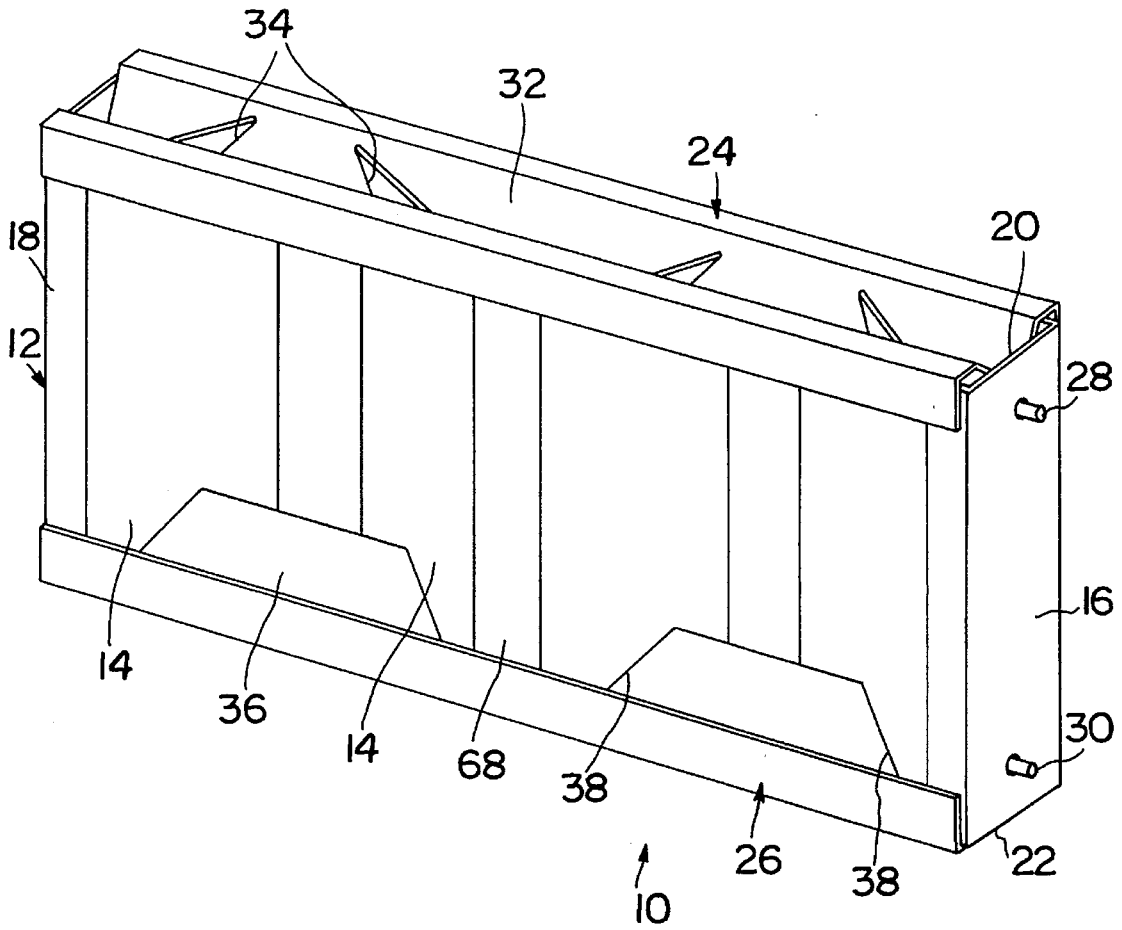
FIG. 1 is a perspective view of a corrugated panel structure in accordance with the invention.

FIG. 1 shows a corrugated panel structure 10 in accordance with the invention. The corrugated panel structure 10 is comprised of a corrugated panel 12 of generally broad, planar configuration, and comprised of a plurality of corrugations 14 between opposite end portions 16 and 18. The corrugations 14 are spaced-apart from and generally parallel to each other and extend between opposite edges 20 and 22 of the corrugated panel 12.

In addition to the corrugated panel 12, the corrugated panel structure 10 includes elongated caps 24 and 26 mounted on the edges 20 and 22 respectively of the corrugated panel 12. As described in greater detail hereafter, the elongated cap 24 is held in place at the edge 20 of the corrugated panel 12 by an elongated rod 28. Similarly, the elongated cap 26 is held in place at the edge 22 of the corrugated panel 12 by an elongated rod 30. The elongated cap 24 has a downwardly protruding central channel 32 extending along the length of the cap 24 in the direction of elongation of the cap 24. The cap 24 has a plurality of slots 34 therein for receiving different ones of the corrugations 14. Similarly, the elongated cap 26 has an upwardly protruding central channel 36 extending along the length of and in the direction of elongation of the elongated cap 26, and having a plurality of slots 38 therein for receiving the corrugations 14.

Without the elongated caps 24 and 26, the corrugated panel 12 has substantial resistance to compression in the direction of the corrugations 14, between the end portions 16 and 18 thereof, in a manner typical of corrugated members. However, the corrugated panel 12, by itself, has relatively little resistance to twisting or lateral forces applied thereto. However, with the elongated caps 24 and 26 mounted on the edges 20 and 22, the resulting corrugated panel structure 10 is greatly rigidified and strengthened, particularly with respect to resisting twisting and lateral forces applied thereto. As described in greater detail hereafter, the caps 24 and 26 are of ridged cross-sectional configuration, which results lateral or bending forces thereon. This same rigidity is imparted to the corrugated panel 12 when the edges 20 and 22 are sandwiched within the caps 24 and 26 and the corrugations 14 secured within the slots in the caps 24 and 26. In addition, the elongated caps 24 and 26 serve to cover over and complete the open edges 20 and 22.

Figure 2:
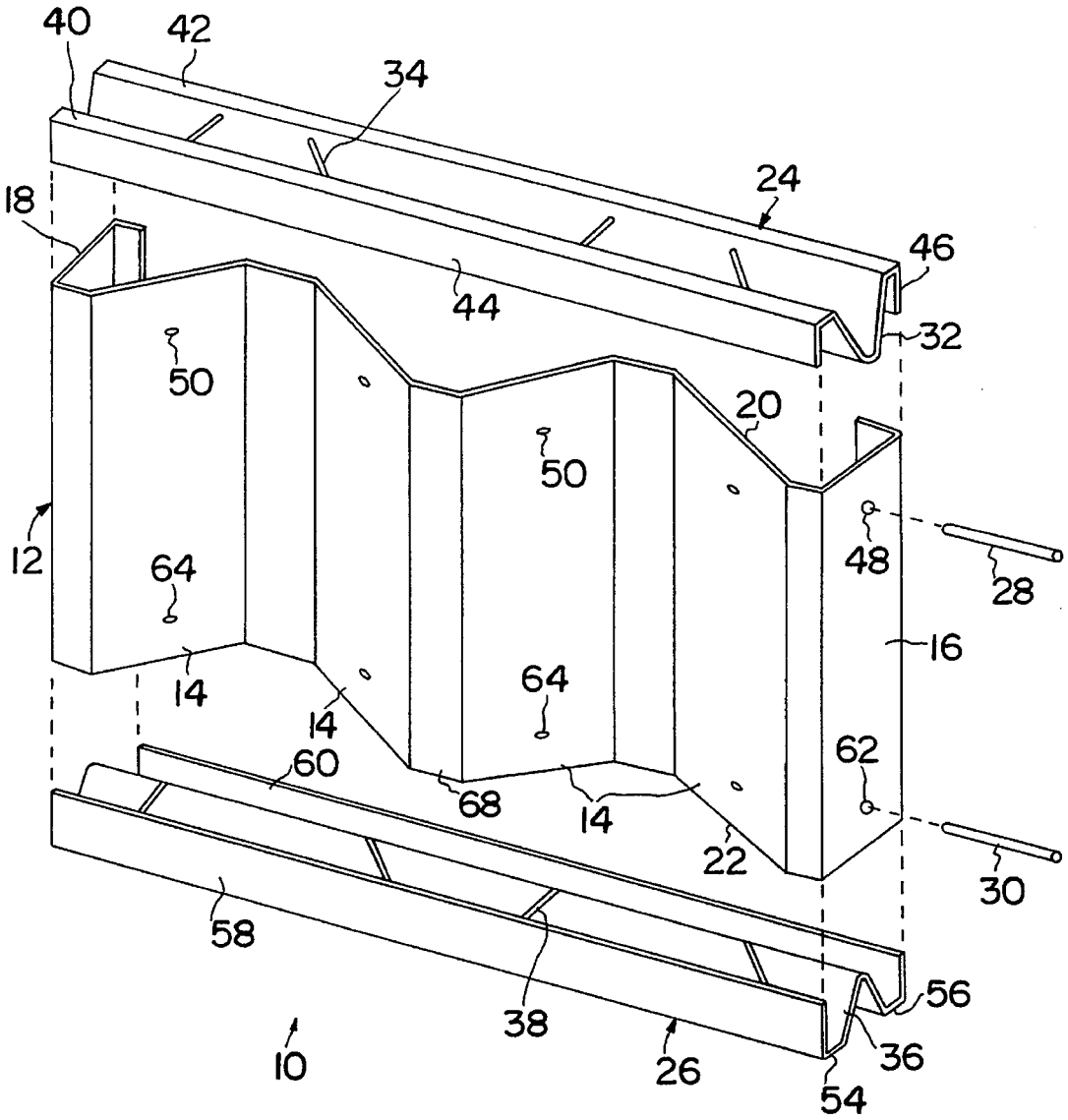
FIG. 2 is a perspective view similar to FIG. 1 but shown in exploded fashion.
Figure 3:
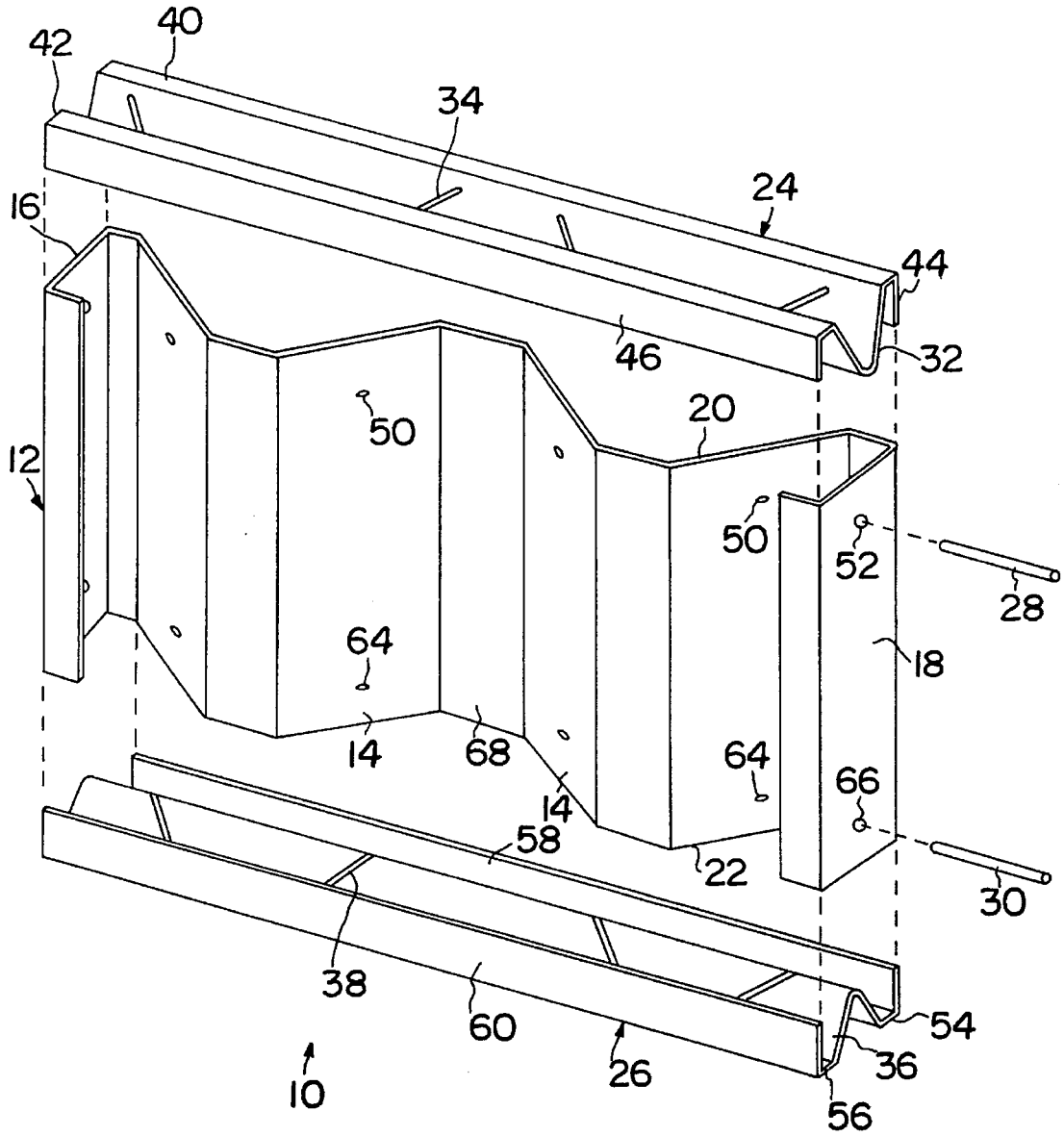
FIG. 3 is an exploded perspective view of the corrugated panel structure of FIG. 1 from an opposite side of the corrugated panel structure from what is shown in FIGS. 1 and 2.

The details of the corrugated panel 12 and the elongated caps 24 and 26 and the manner in which they interconnect with each other can be better understood with reference to the exploded perspective views of FIGS. 2 and 3. The exploded perspective view of FIG. 2 is from basically the same orientation as the perspective view of FIG. 1, while the exploded perspective view of FIG. 3 is of the opposite side of the corrugated panel structure 10. The central channel 32 of the elongated cap 24 is disposed between and protrudes downwardly from an opposite pair of side portions 40 and 42 which lie within a common plane. The slots 34 in the central channel 32 receive the upper edges of the corrugations 14. The side portions 40 and 42 include flanges 44 and 46 respectively which extend at generally right angles relative to the common plane from outer edges of the side portions 40 and 42 opposite the central channel 32. The flanges 44 and 46 extend over opposite portions of the upper edge 20 of the corrugated panel 12.

Figure 4:
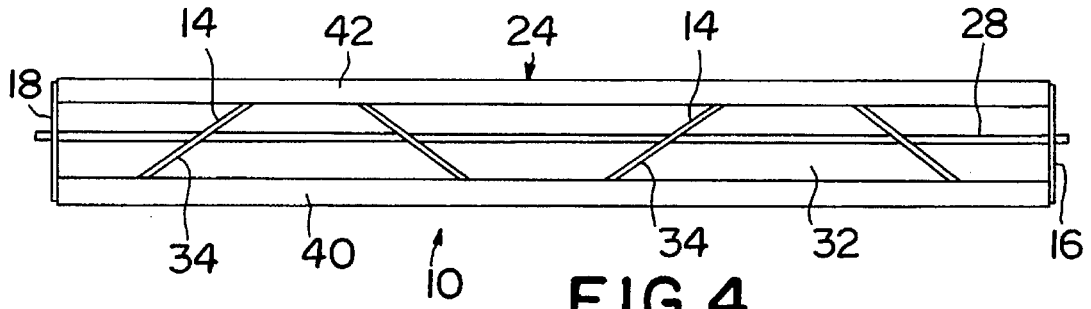
FIG. 4 is a top view of the corrugated panel structure of FIG. 1.

The elongated cap 24 is held in place on the edge 20 of the corrugated panel 12 by the elongated rod 28. Only a small portion of the rod 28 is shown in FIGS. 2 and 3 for simplicity of illustration. With the elongated cap 24 seated on the edge 20, the rod 28 is inserted through an aperture 48 in the end portion 16, then through a series of apertures 50 in the corrugations 14 before passing through an aperture 52 in the end portion 18 (shown in FIG. 3). As shown in FIG. 4, the rod 28 as thusly installed resides at the bottom of the central channel 32.

The elongated cap 26 is of like configuration to that of the elongated cap 24, but is disposed upside down so that the central channel 36 protrudes upwardly along the length of the elongated cap 26 in the direction of elongation thereof. A pair of side portions 54 and 56 disposed on opposite sides of the central channel 36 and lying within a common plane terminate in flanges 58 and 60 respectively which extend upwardly at generally right angles relative to the common plane of the side portions 54 and 56. The flanges 58 and 60 extend over opposite portions of the edge 22 of the corrugated panel 12.

As in the case of the elongated cap 24, the elongated cap 26 is held in place at the edge 22 of the corrugated panel 12 by the elongated rod 30. The rod 30 extends through an aperture 62 in the end portion 16, then through a plurality of apertures 64 in the corrugations 14 before exiting through an aperture 66 in the end portion 18 (shown in FIG. 3). The rod 30 resides within the central channel 36 to hold the elongated cap 26 on the edge 22 of the corrugated panel 12.

FIG. 4 shows the elongated cap 24 mounted on the edge 20 of the corrugated panel 12, and with the elongated rod 28 in place. The rod 28 resides at the bottom of the central channel 32, and is disposed within apertures in the end portions 16 and 18 and the corrugations 14 as previously described, to hold the elongated cap 24 in the mounted position on the edge 20.

Figure 5:
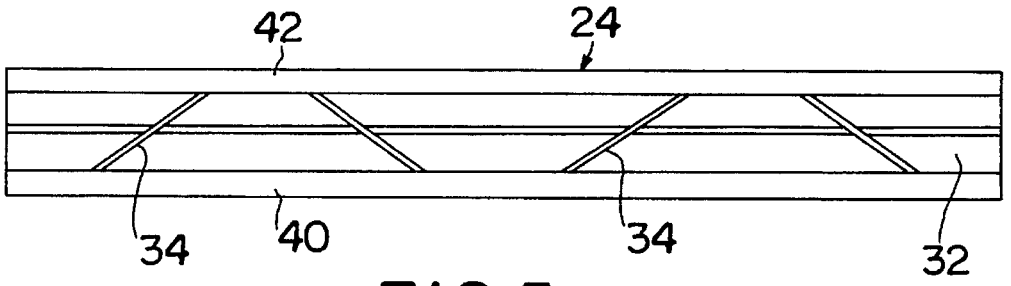
FIG. 5 is a top view of the upper elongated cap of the corrugated panel structure of FIG. 1.
Figure 6:
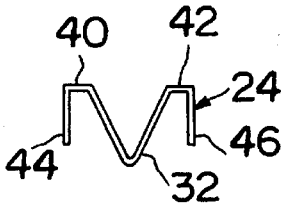
FIG. 6 is a right end view of the elongated cap of FIG. 5.

FIG. 5 shows the elongated cap 24 by itself, and illustrates the slots 34 in the central channel 32. A right end view of the elongated cap 24 is shown in FIG. 6. As seen in FIG. 6, the side portions 40 and 42 reside within a common plane on opposite sides of the central channel 32. The central channel 32 is generally V-shaped in cross-sectional configuration. The flanges 44 and 46 extend downwardly at approximately right angles relative to the common plane of the side portions 40 and 42.

Figure 7:
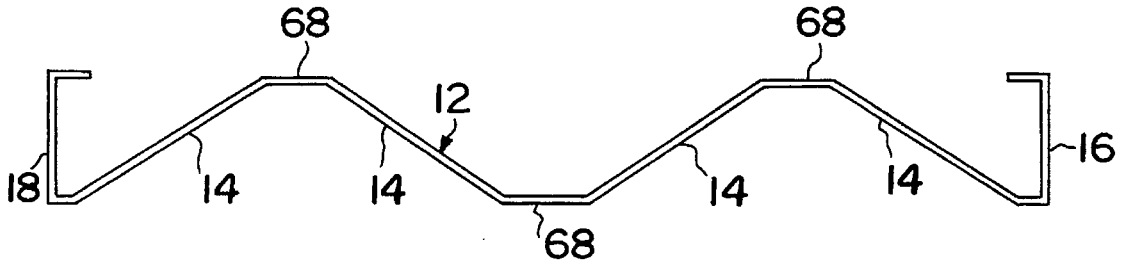
FIG. 7 is a top view of the corrugated panel of the corrugated panel structure of FIG. 1.

FIG. 7 is a top view of the corrugated panel 12. As shown in FIG. 7, the corrugations 14 form a generally zig-zag pattern between the opposite end portions 16 and 18. The corrugations 14, which are generally planar in configuration, and which are interconnected by intermediate portions 68, are diagonally oriented and alternate in direction relative to the direction of elongation of the corrugated panel 12 and the caps 24 and 26. Consequently, the slots 34 within the elongated cap 24, and the slots 38 within the elongated cap 26, are also diagonally oriented and alternate in direction relative to the direction of elongation of the caps 24 an 26.

Figure 8:
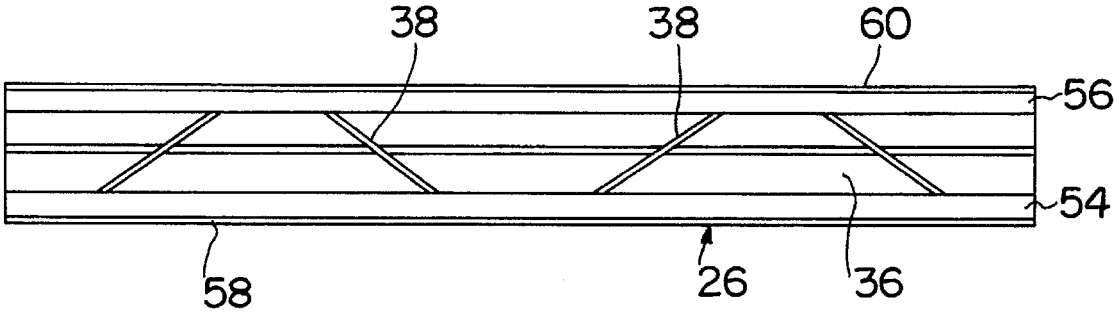
FIG. 8 is a top view of the lower elongated cap of the corrugated panel structure of FIG. 1.
Figure 9:
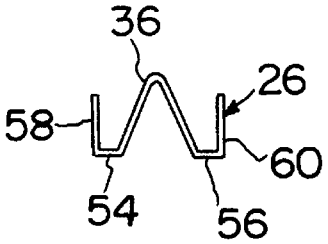
FIG. 9 is a right end view of the elongated cap of FIG. 8.

FIG. 8, is a top view of the upturned elongated cap 26 at the bottom of the corrugated structure 10. The flanges 58 and 60 extend upwardly from the side portions 54 and 56 opposite the central channel 36. The central channel 36 has the slots 38 therein, as previously described. FIG. 9 is a right end view of the elongated cap 26. As in the case of the elongated cap 24 of FIG. 6, the cap 26 of FIG. 9 includes the central channel 36 of generally V-shaped cross-sectional configuration between the side portions 54 and 56, which reside within a common plane. The flanges 58 and 60 extend upwardly at generally right angles relative to the common plane of the side portions 54 and 56.

The corrugated panel structure 10 is assembled simply by mounting the elongated caps 24 and 26 on the opposite edges 20 and 22 of the corrugated panel 12. The elongated cap 24 is mounted on the edge 20 by sliding the cap 24 into place so that the corrugations 14 reside within the slots 34 and the flanges 44 and 46 are disposed at opposite sides of the edge 20 of the corrugated panel 12. The elongated rod 28 is then inserted through the aperture 48 in the end portion 16, the apertures 50 in the corrugations 14, and the aperture 52 in the end portion 18, to secure the elongated cap 24 in place on the edge 20 of the corrugated panel 12. The elongated cap 26 is mounted on the opposite edge 22 of the corrugated panel 12, in similar fashion.

When desired, the corrugated panel structure 10 may be disassembled by removing the elongated rods 28 and 30. This enables the elongated caps 24 and 26 to be pulled away from the opposite edges 20 and 22 of the corrugated panel 12, to thereby disassemble the corrugated panel structure 10.

Accordingly, the corrugated panel structure 10 is easily assembled to form a broad, planar structure which may be used in the construction of building walls and other similar structural applications. Where desired, the cap 24 or the cap 26 may be secured to a ceiling or a floor, with the corrugated panel 12 being thereafter joined thereto through use of the elongated rods 28 and 30. The assembled corrugated panel structure 10 forms the basic superstructure for a building wall, and is ready for finishing such as by simply mounting drywall on the side thereof, and with insulation placed within the spaces defined by the corrugations 14, as desired. The outer surface of the wall thus created can be finished by applying stucco or other appropriate exterior finishing material. The assembled corrugated wall structure is strong and rigid and does not have to be sheared such as by adding plywood panels as in the case of many conventional wall structures.

While the invention has been particularly shown and described with reference to a preferred embodiment thereof, it will be understood by those skilled in the art that various changes in form and details may be made therein without departing from the spirit and scope of the invention.

What is claimed is:

1. A corrugated panel structure comprising the combination of:

a corrugated panel of generally broad, planar configuration and having a plurality of spaced-apart, generally parallel corrugations extending between a pair of opposite edges thereof; and an elongated cap mounted on one of the pair of opposite edges of the corrugated panel and including a central channel extending in a direction of elongation of the cap and having slots therein receiving the plurality of corrugations of the corrugated panel therein;

the plurality of corrugations of the corrugated panel having apertures therein adjacent the one of the pair of opposite edges of the corrugated panel, and further including a rod extending through the apertures in the plurality of corrugations and disposed within the central channel of the elongated cap to secure the elongated cap on the corrugated panel.

2. A corrugated panel structure comprising the combination of:

a corrugated panel of generally broad, planar configuration and having a plurality of spaced-apart, generally parallel corrugations extending between a pair of opposite edges thereof;

a first elongated cap mounted on one of the pair of opposite edges of the corrugated panel and including a central channel extending in a direction of elongation of the first cap and having slots therein receiving the plurality of corrugations of the corrugated panel therein;

a second elongated cap mounted on the other one of the pair of opposite edges of the corrugated panel and including a central channel extending in a direction of elongation of the second cap and having slots therein receiving the plurality of corrugations of the corrugated panel therein;

the plurality of corrugations of the corrugated panel having apertures therein adjacent the one and the other of the pair of opposite edges of the corrugated panel, and further including a first rod extending through the apertures in the plurality of corrugations adjacent the one of the pair of opposite edges of the corrugated panel and disposed within the central channel of the first elongated cap to secure the first elongated cap on the first of the pair of opposite edges of the corrugated panel, and a second rod extending through the apertures in the plurality of corrugations adjacent the other one of the pair of opposite edges of the corrugated panel and disposed within the central channel of the second elongated cap to secure the second elongated cap on the other one of the pair of opposite edges of the corrugated panel.

3. A corrugated panel structure comprising the combination of:

a corrugated panel of generally broad, planar configuration having opposite end portions extending between opposite first and second edges of the panel and a plurality of corrugations forming a generally zig-zag pattern between the opposite end portions and extending in generally parallel fashion between the opposite first and second edges of the panel;

first and second caps mounted on the opposite first and second edges (respectively of the panel and each extending between the opposite end portions of the panel and having slots therein receiving the plurality of corrugations of the panel, and means for coupling the first and second caps to the opposite first and second edges of the panel;

the plurality of corrugations having apertures therein adjacent the first and second edges of the panel, and the means for coupling comprising first and second rods extending through the apertures in the plurality of corrugations adjacent the first and second edges of the panel respectively and engaging the first and second caps respectively.

4. A corrugated panel structure comprising the combination of:

a corrugated panel of generally broad, planar configuration having opposite end portions extending between opposite first and second edges of the panel and a plurality of corrugations forming a generally zig-zag pattern between the opposite end portions and extending in generally parallel fashion between the opposite first and second edges of the panel:

first and second caps mounted on the opposite first and second edges respectively of the panel and each extending between the opposite end portions of the panel and having slots therein receiving the plurality of corrugations of the panel; and means for coupling the first and second caps to the opposite first and second edges of the panel;

each of the first and second caps having a protruding central channel extending along the corrugated panel between the opposite end portions and having the slots therein for receiving the plurality of corrugations of the panel;

the slots in the protruding central channel of each of the first and second caps being diagonally oriented and alternating in direction relative to a direction of elongation of the cap along the corrugated panel.

5. A corrugated panel structure in accordance with claim 4, wherein each of the first and second caps has a pair of spaced-apart side portions on opposite sides of the protruding central channel of the cap which lie within a common plane and terminate in flanges opposite the central channel which extend at generally right angles to the common plane.

6. A corrugated panel structure in accordance with claim 5, wherein the central channel is generally V-shaped in cross-section.

* * * * *